United States Patent [19]

Nee

[11] 4,054,088

[45] Oct. 18, 1977

[54] TRASH COMPACTOR

[75] Inventor: Michael A. Nee, Melrose, Mass.

[73] Assignee: Norris Industries, Inc., Los Angeles, Calif.

[21] Appl. No.: 672,862

[22] Filed: Apr. 2, 1976

[51] Int. Cl.[2] ..... B30B 1/18

[52] U.S. Cl. ..... 100/214; 100/229 A; 100/290

[58] Field of Search ..... 100/214, 229 A, 240, 100/290, 229 R; 141/71, 73, 80; 53/124 B

[56] References Cited

U.S. PATENT DOCUMENTS

| | | | |
|---|---|---|---|
| 3,772,984 | 11/1973 | Karls | 100/214 |
| 3,680,475 | 8/1972 | Gladwin | 100/214 |
| 3,714,890 | 2/1973 | Moon | 100/229 A |

*Primary Examiner*—Billy J. Wilhite

[57] ABSTRACT

A trash compactor has trash compacting means attached to a chassis that is supported in the upper end of the housing for limited movement relative to its side walls and is detachable in a manner facilitating servicing of the trash compacting means. The chassis moves upwardly in response to reaction force developing on the application of compacting pressures to the trash by the compacting means and, at its upper limit of travel, it transfers the reaction forces to the side walls of the housing.

11 Claims, 14 Drawing Figures

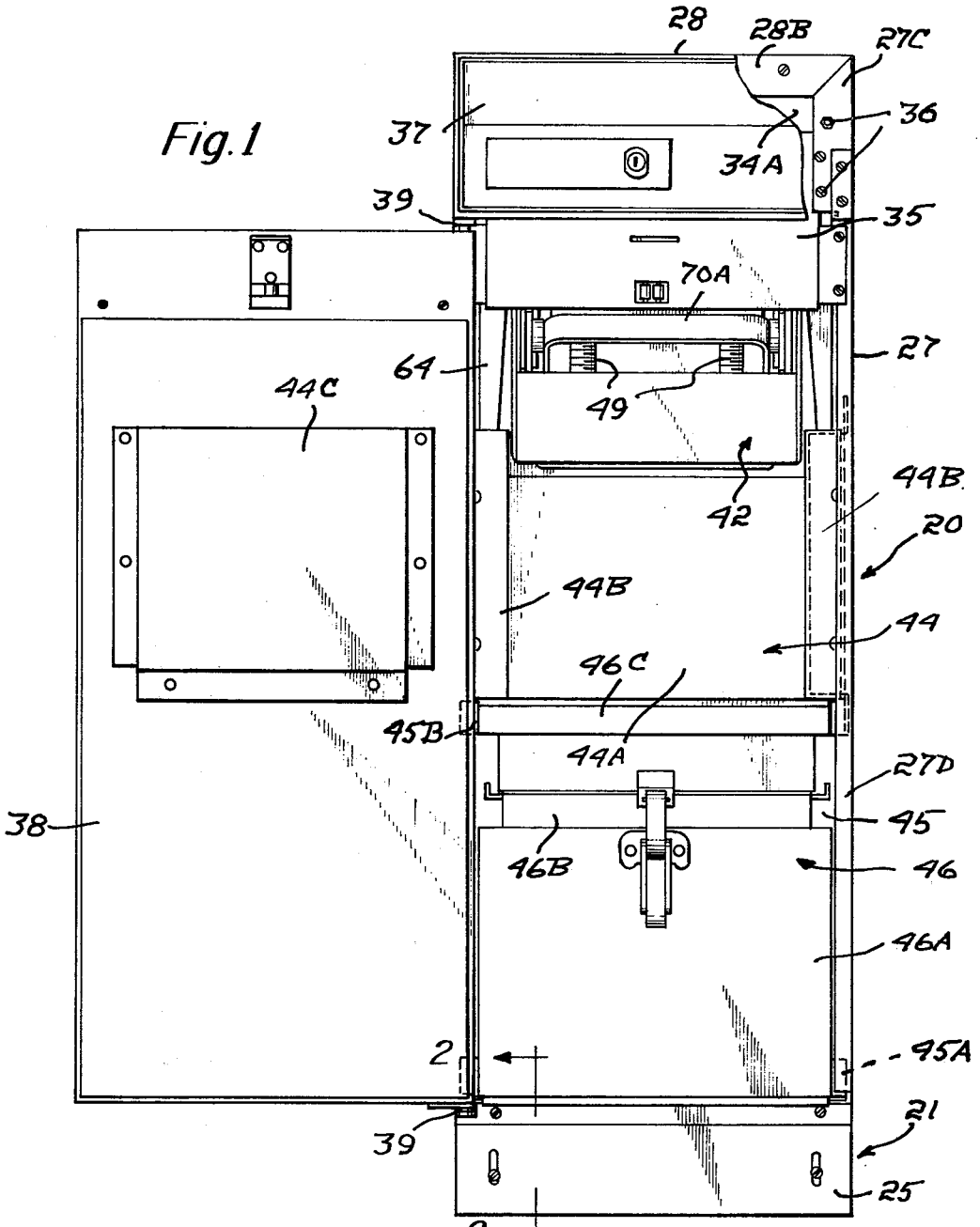
Fig. 1
28
28B
27C
37
36
34A
39
35
70A
27
64
44C
49
42
44B
20
44B
44
46C
45B
44A
27D
38
45
46B
46
46A
2
45A
39
21
25
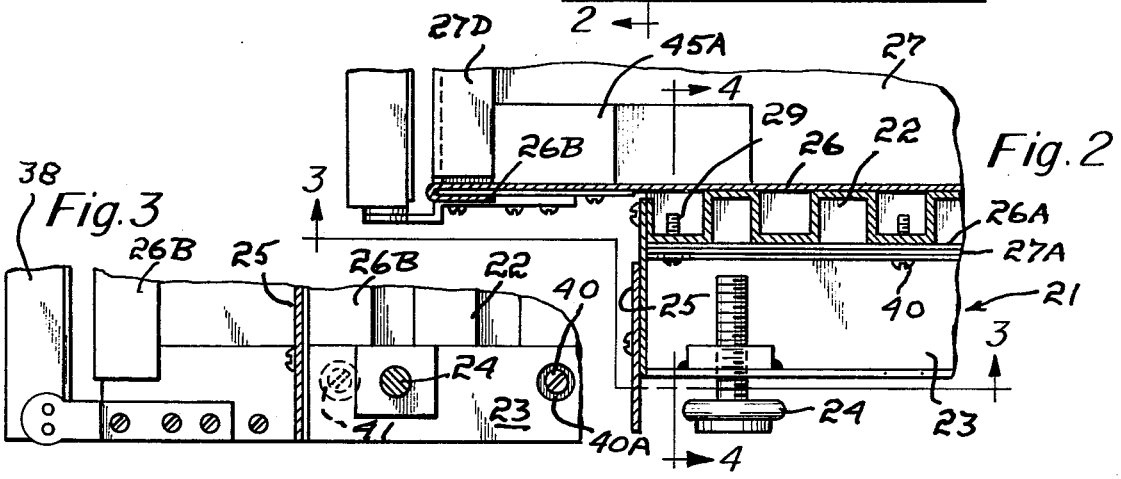
27D
2
45A
27
4
29
26
22
26B
Fig. 2
26A
27A
40
21
25
3
24
23
4
38
Fig. 3
26B
25
26B
22
40
3
24
41
23
40A 43B
C
43
28
43C
43D
7
7
43B
30
34B
34
47
39
65
65
32
53
64
42
44C
44
44A
44B
38
46C
45B
46B
20
45
27
45A
39
21
24
46A
46
25

45
20
45A
27
27A
26
26A
27
29
21
23
24
23

TRASH COMPACTOR

RELATED APPLICATIONS

U.S. Ser. No. 580,578, filed May 27, 1975, now U.S. Pat. No. 3,979,008.

U.S. Ser. No. 580,579, filed May 27, 1975, now U.S. Pat. No. 4,000,689.

U.S. Ser. No. 659,126, filed Feb. 18, 1976

BACKGROUND OF THE INVENTION

Trash compactors of the household type have their trash compacting means supported in the upper ends of their housings. Servicing of the means by which the compacting heads are reciprocated is relatively difficult in the case of parts located close to the top wall of the housings.

THE PRESENT INVENTION

The general objective of the present invention is to provide a construction that will ensure that the means by which the compacting head is reciprocated can be serviced with maximum ease and convenience, an objective attained by connecting the compacting head and the means by which it is reciprocated to a chassis with some parts positioned on its upper surface.

The chassis is supported in the upper end of the housing in a manner enabling it to be quickly and easily so detached as to permit access to such parts and, at the same time, ensure that in use the reaction forces developing on the application of compacting pressure to trash are transferred directly to the side walls of the housing transversely of a substantial part of each of them.

Another objective of the invention is to provide a support that enables the chassis to be a free fit within the upper end of the housing, an objective attained with the supporting means permitting limited upward movement of the chassis relative to the housing side walls, the chassis moving upwardly in response to the reaction forces and at the upper limit of its movement, transferring such forces to the side walls transversely of a substantial part of each of them.

Another objective of the invention is to provide supporting means that avoid direct connection of the chassis with the housing sides, an objective attained by providing front and rear shelves on which the chassis rests with the rear shelf detachable and the chassis connected to the front shelf in a manner permitting the rear end of the chassis to be lowered to expose its upper surface and with the chassis having end and side walls which are spaced from the housing top wall but engageable therewith substantially throughout their lengths to limit the upward movement of the chassis.

BRIEF DESCRIPTION OF THE DRAWINGS

A preferred embodiment of the invention is illustrated by the accompanying drawings of which FIG. 1 is a front view of a compactor in accordance with the invention;

FIG. 2 is a fragmentary section, on an increase in scale, taken approximately along the indicated line 2—2 of FIG. 1;

FIG. 3 is a section taken approximately along the indicated line 3—3 of FIG. 2;

THE PREFERRED EMBODIMENT OF THE INVENTION

The housing of the household compactor illustrated by the drawings is generally indicated at 20 and is generally similar to that shown and described in the copending application of Charles B. Weeks and Paul V. Choate, Ser. No. 659,126, filed Feb. 18, 1976. It is, however, again described in order that the preferred embodiment of the present invention may be fully disclosed.

Figure 4:
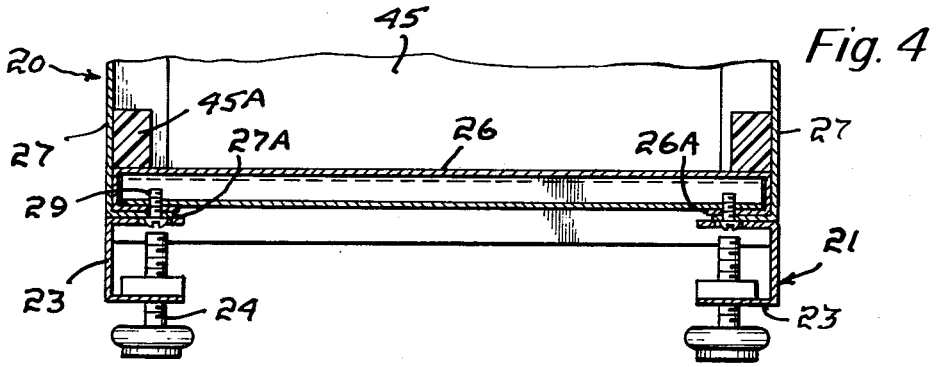
FIG. 4 is a section taken approximately along the indicated line 4—4 of FIG. 2.

The base of the compactor is generally indicated at 21 and includes, see FIGS. 2, 3, and 4, a transversely corrugated bed 22 and a supporting channel 23 at each side of the base, the channels opening towards each other with vertically adjustable leveling legs 24 threaded through their lower walls. A vertically adjustable toe plate 25 is secured to the front end of the base. A floor plate 26 has margins 26A folded about the sides of the bed 22 and secured between it and the upper walls of the channels 23 in a manner later described. The floor plate 26 extends forwardly of the bed 22 and includes a folded end portion 26B.

The housing includes side walls 27 and a top wall 28 which are integral sections of a metal sheet and the bottom portions 27A of the side walls are folded inwardly under the floor plate margins 26A and are anchored therewith to the undersurface of the bed 22 at the corners thereof by screws 29.

Figure 6:
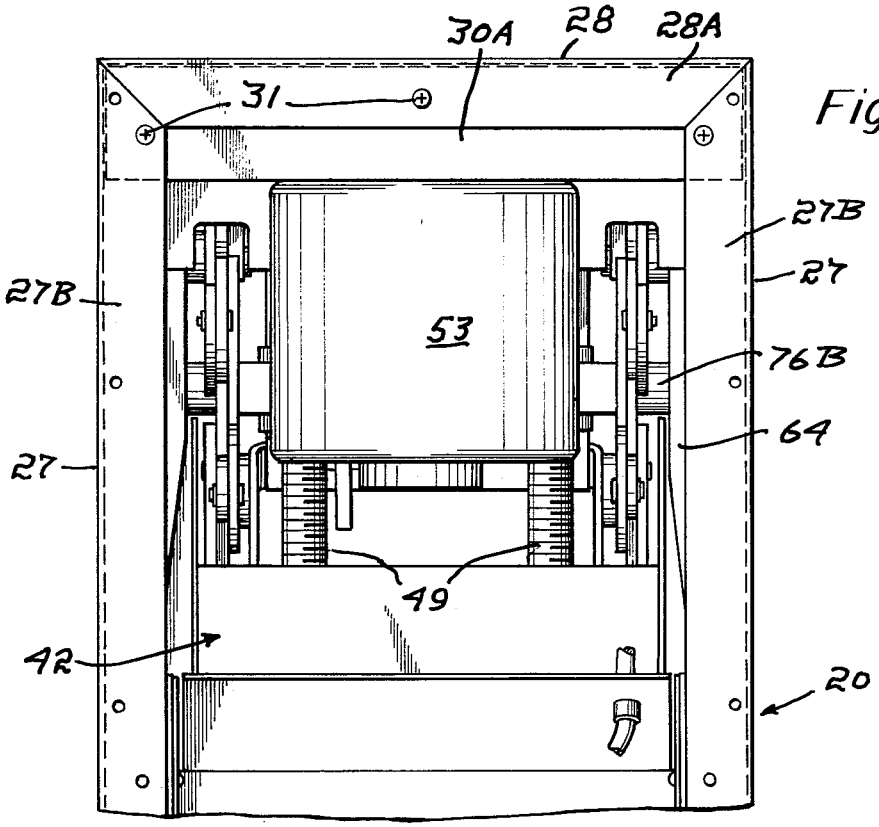
FIG. 6 is a rear view of the upper part of the compactor with its rear wall removed.
Figure 7:
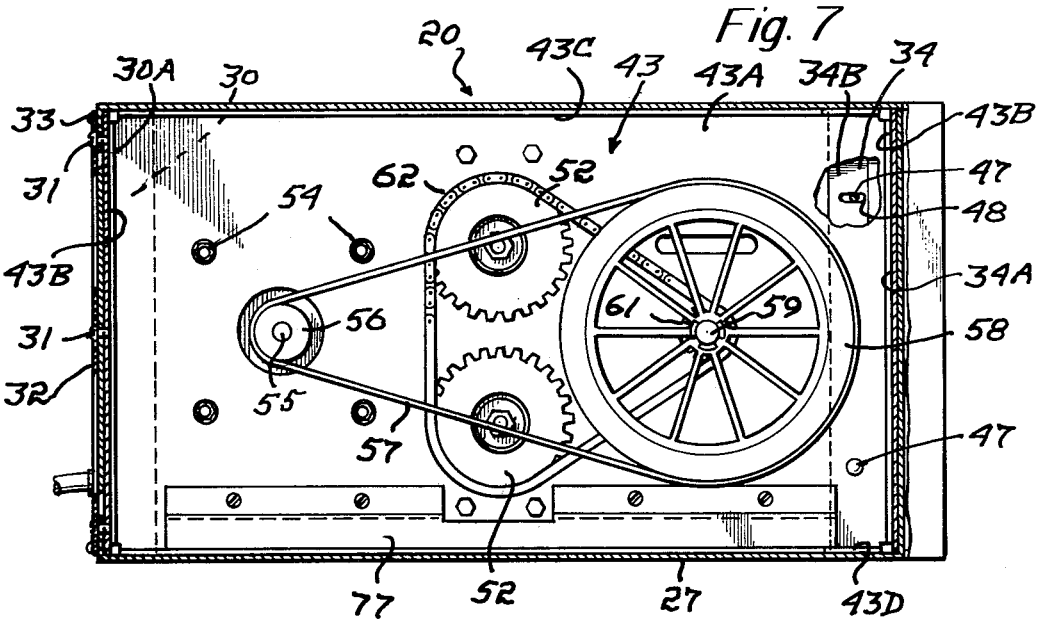
FIG. 7 is a section taken approximately along the indicated line 7—7 of FIG. 5.

As shown in FIGS. 6 and 7 the rear edge 28A of the top and rear ends 27B of the side walls are bent inwardly and downwardly, respectively, with their proximate ends mitered. The wall 30A of a shelf 30 is secured to the inner surfaces of the wall portions 27B and 28A by screws 31 and a rear wall 32 is detachably attached to their outer surfaces by screws 33. The front edge of the top wall 28, see FIG. 1, is bent downwardly as at 28B and the front edges of the side walls 27 are bent inwardly as at 27C. The wall 34A of a shelf 34 and a plate 35 are secured by screws 36 to the inner surfaces of the top wall portion 28B and the proximate ends of the side wall portions 27C. Below the plate 35, the front edges 28C of the side walls 27 are bent inwardly and then rearwardly to provide rigid margins 27D at the front of the housing 20 that present a finished appearance. A front panel 37 conceals the shelf wall 34B and the upper part of the plate 35. A door 38 is connected to one side wall of the housing 20 by hinges 39 and is dimensioned to close the space between the panel 37 and the base 21.

Before describing the compacting means and other features of the compactor, it is noted that the housing 20 is secured to the base 21, as may best be seen in FIGS.

2 and 3 by screws 40 extending through the upper walls of the channel member 23, the interposed margins 26A and 27A of the base and side walls, respectively, and corrugations of the base 21 with which they are in contact. The lower walls of the channels 23 are provided with holes 40A facilitating the use of the screws 40 and their upper walls have holes 41 freely accommodating the heads of the screws 29.

The trash compacting means includes a trash compacting head or ram generally indicated at 42 and means to reciprocate it between an upper inoperative position and lower, trash-compacting positions and connected to and supported by a chassis, generally indicated at 43 resting on the front and rear shelves 34 and 30, respectively.

Before detailing the head reciprocating means, it will be noted that the compacting head 42 is in the upper end of a throat, generally indicated at 44 and opening into the chamber 45 in which a trash receiver, generally indicated at 46 is located.

The trash receiver 46 is or may be that shown in the above referred-to applications and is not, accordingly, detailed herein other than to note that it includes a pan 46A that is a free fit within the chamber 45 and is centered by guides 45A and receives a conventional disposable trash bag, not shown, and a container 46B that fits within the bag and is seated on the bottom of the pan 46A and extends upwardly therefrom with the frame 46C at its upper end underlying and shielded by the throat 44 and centered by guides 45B.

The throat 44 includes a rear part 44A, and side parts 44B, all secured to the inside of the housing 20 and a front part 44C attached to the inner surface of the door 38. The front part 44C is an upwardly opening container that may serve for trash bag storage and also for a deoderizer. With the door open, the throat 44 is opened to permit trash to be deposited in the receiver and the throat parts are of sufficient strength to withstand compacting pressures if the trash builds up into it.

Figure 5:
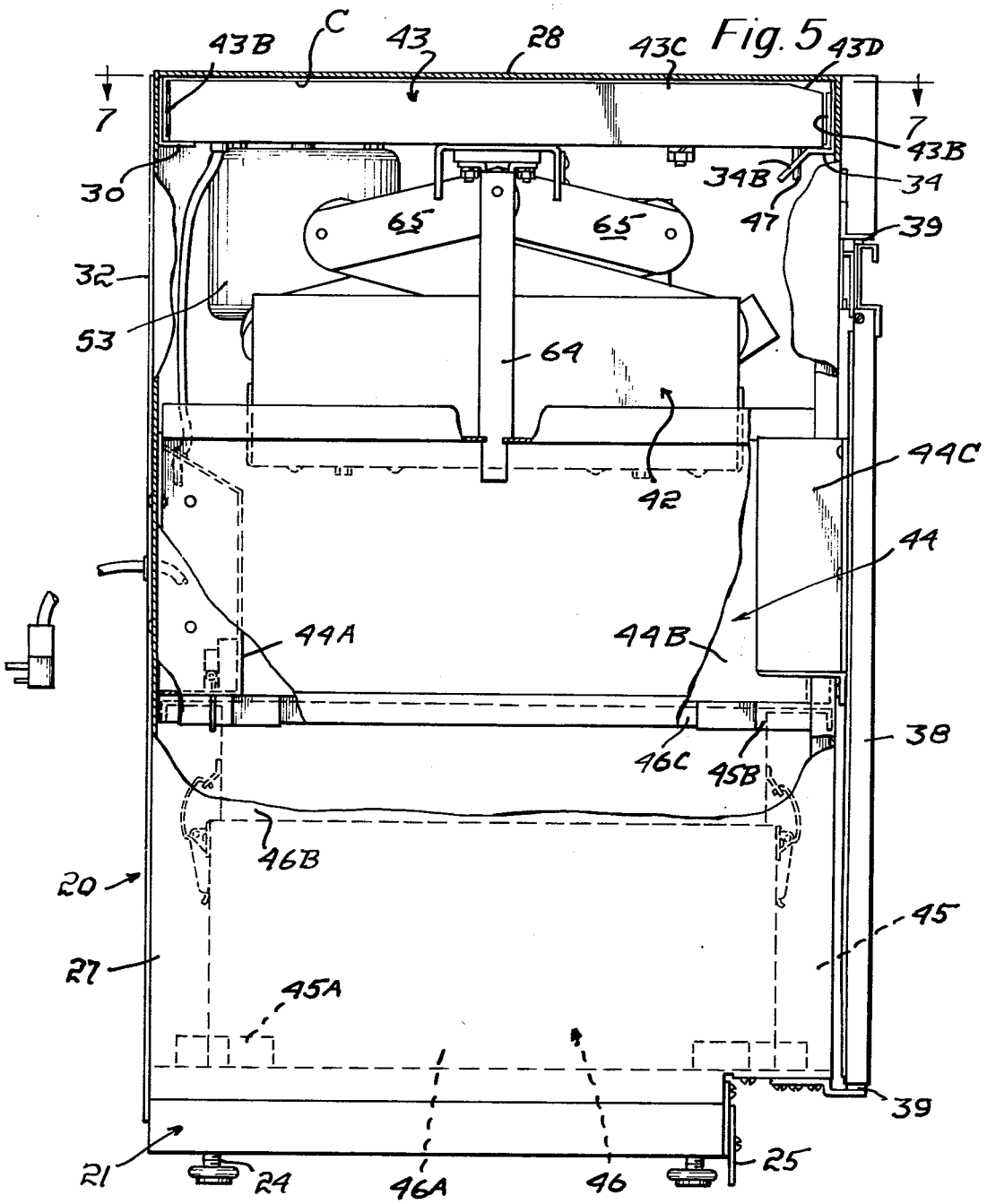
FIG. 5 is a side view of the compactor with the side wall partly broken away.
Figure 8:
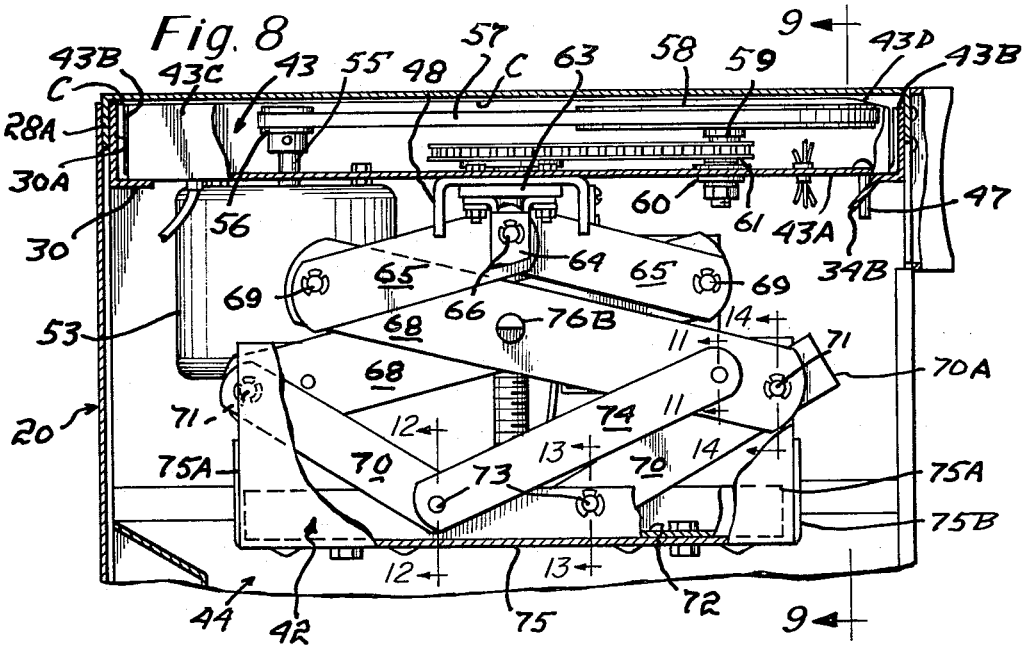
FIG. 8 is a partly sectioned side view of the upper part of the compactor.
Figure 9:
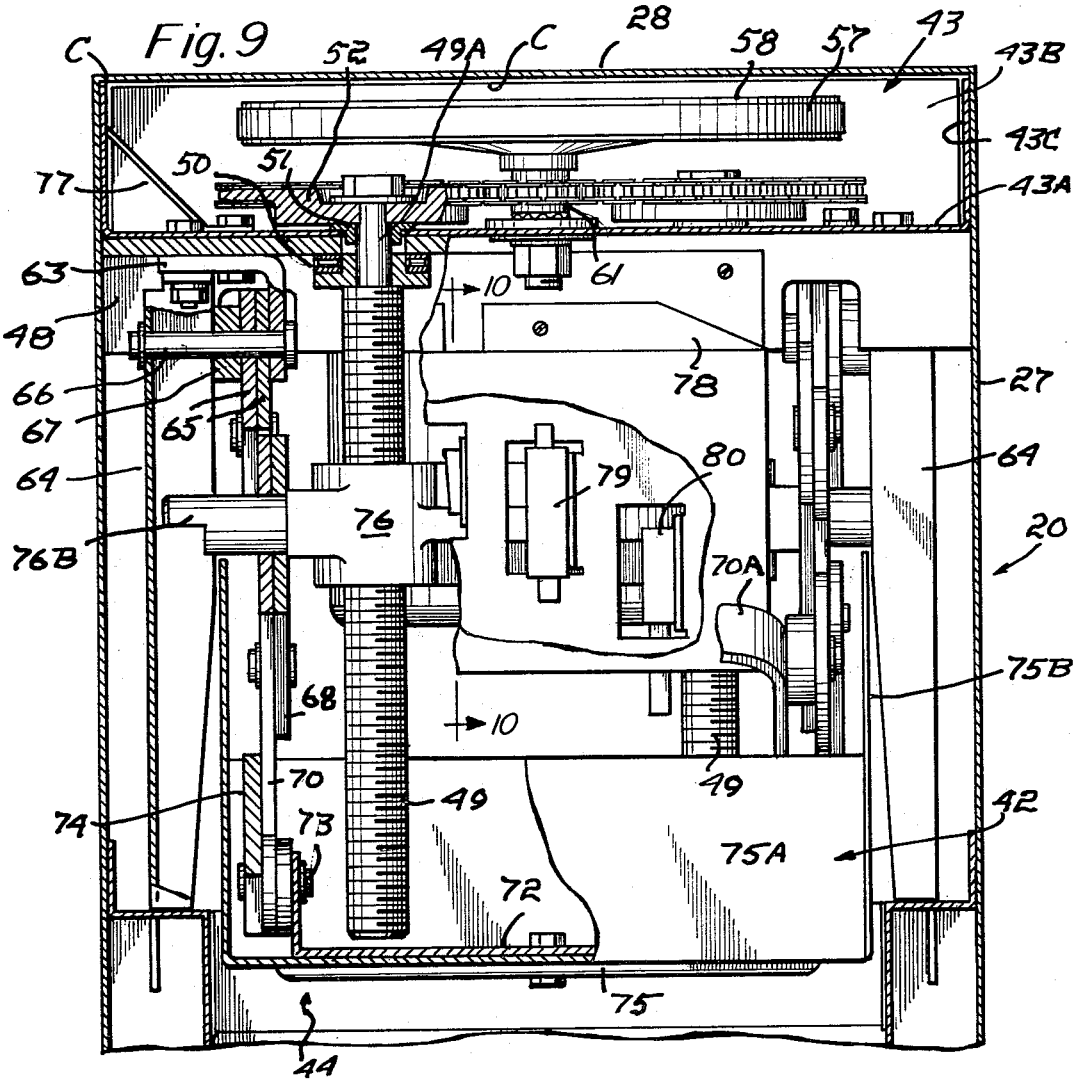
FIG. 9 is a section taken approximately along the indicated line 9—9 of FIG. 8.

The chassis 43, see FIGS. 5, 7, and 8, is a close but free fit in the upper end of the housing 20 and includes a plate 43A, vertical end walls 43B and vertical side walls 43C. The walls 43B fit between the shelf walls 34A and 30A and the walls 43C fit between the side walls 27 of the housing substantially at the junction of the top wall 28 therewith but with a slight clearance therebetween such that short limited vertical movement of the chassis 43 is provided for. In FIGS. 5, 8, and 9, the clearance is exaggerated and indicated at C. The front end of the chassis plate 43A has depending pins 47 extending downwardly through slots 48 in the downwardly inclined edge portion 34B of the front shelf. It will be noted that the rear shelf 30 is easily detached from the housing once the back or rear wall 32 of the housing is removed and that the front ends of the chassis side walls 43C are downwardly inclined as at 43D so that, once the rear shelf is released, the rear end of the chassis may be lowered and held with its front end still remaining caught and the chassis supported by the front shelf 34. The chassis 43 may be removed by lowering its rear end a further distance such that the pins 47 come free.

The plate 43A has, see FIGS. 8 and 9, a transverse, centrally located downwardly opening channel 48 secured to its undersurface. Two vertically and laterally spaced screws 49 are rotatably supported thereby. As may best be seen in FIG. 9, each screw 49 has an upper shaft end 49A extending freely through the channel 47 with a thrust bearing 50 interposed between the shoulder defined by the shaft end 49A and the channel 48 and with a flanged bushing 51 between a sprocket 52 fixed on the upper end of the shaft end 49A and the upper surface of the channel 47.

An electric motor 53 under the plate 43A is attached to the rear portion thereof as by bolts 54 with its drive shaft 55 extending upwardly therethrough and provided with a pulley 56 connected by a belt 57 to a pulley 58 mounted on a vertical shaft 59 rotatably attached to the upper surface of the plate 43A as at 60 and having a sprocket 61, the sprocket 61 connected to the sprockets 52 by a chain 62.

An L-shaped hanger 63 and the upper end of vertical guide channel 64 are secured within the channel 47 adjacent each end thereof. A pair of supporting links 65 is connected to each hangers 63 by a pivot 66 with its end extending through the associated guide channel 64 and a spacer 67 between it and the links. The compacting head 42 is supported by two identical sets of linkage of the lazy tong type and each set includes a first, somewhat longer pair of drive links 68 each connected at one end to the other end of the appropriate one of the supporting links 65 by pivots 69 and a second pair of links 70, each connected at one end to the other end of the appropriate one of the links 68 by a pivot 71 and at its other end to the side walls of the stiffening plate 72 of the compacting head by a pivot 73, with the pivots 73 located on opposite sides of the plane of the screws 49. It will be noted that one pair of the links 70 includes an integral connection 70A. One of the links 68 of each pair has a stabilizing link 74 pivotally connected thereto as at 75, the links 74 extending past the screws 49 and are connected to the side walls of the stiffening plate 72 by the pivots 73 for the other links 68.

The compacting head 42 includes a ram face 75 bolted to the plate 72 and having upwardly disposed end walls 75A and side walls 75B enclosing it. As is apparent from FIG. 1, the front end wall 75A is of a height sufficient to prevent trash from being deposited on top of the plate 72. The side walls 75B are of a height such that in the lowermost position of the compacting head 42, the upper edges of the side walls 75B will be above the lower ends of the side parts 44B of the throat which parts anchor the lower, outwardly inclined ends of the guide channels 64.

Figure 10:
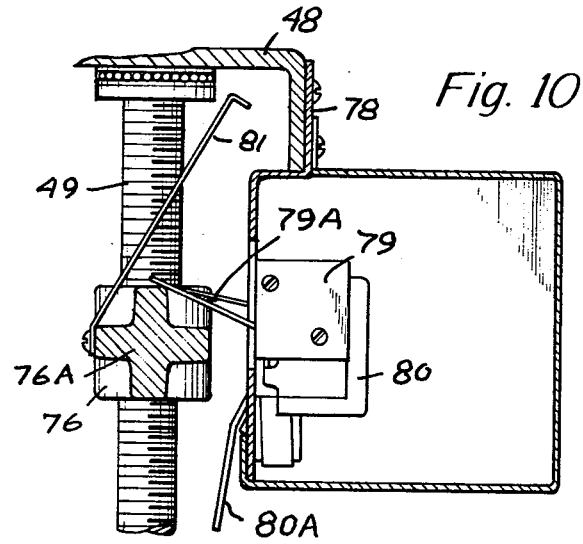
FIG. 10 is a section taken approximately along the indicated line 10—10 of FIG. 9.
Figure 11:
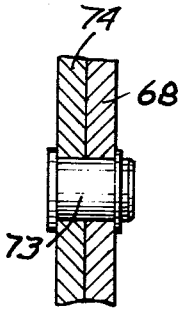
FIGS. 11, 12, 13, and 14 are sections taken approximately along the indicated lines 11—11, 12—12, 13—13, and 14—14, respectively, of FIG. 8.
Figure 12:
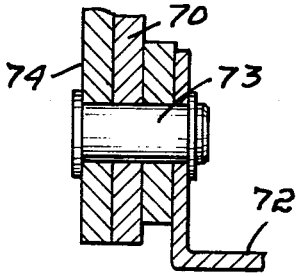
Figure 13:
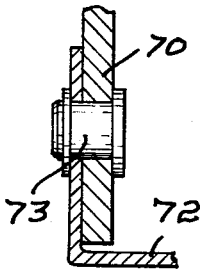
Figure 14:
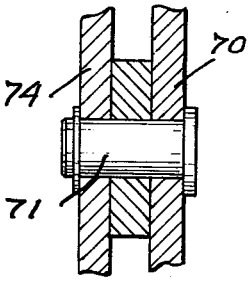

The screws 49 are threaded through a transverse drive shaft 76, see FIGS. 9 and 10, that has a central section 76A that is cruciform in cross section and end portions 76B that are pivots, each pivotally interconnecting the pair of links 68 of one set of links and with its shouldered end extending into the appropriate one of the guide channels 64. Thus, the two sets of links are extended or retracted in the same manner depending on the direction the motor 53 is operated and, accordingly, the direction in which the drive screws 49 turn.

The control circuit is not detailed as it is or may be identical to that disclosed in said application but it will be noted that the chassis 43 is provided with a channel 77 to protect wiring and that the front wall of the channel 47 is provided with a hanger 78 in support of an upper limit switch 79 and a lower limit switch 80. The switch arm 79A is actuated by the shaft 76 to open the switch 79 when the compacting head 42 is in its uppermost position. The arm 80A of the lower limit switch is actuated when the compacting head 42 reaches its lowermost position by an actuator 81 attached to the shaft section 76A then to cause the motor 53 to reverse. The motor 53 is of the type that reverses if resistance to travel of the compacting head 42 causes its speed to drop below a predetermined rate.

In operation, as the compacting head 42 encounters trash, reactor forces develop that exert an upward force on the chassis 43, lifting it until its side walls 43C engage the housing top wall 28 substantially at its junction with the side walls 27 thereby transferring such forces to the side walls, the lower ends of which are clamped between the floor plate 26 and the base 21. As the compacting head 42 returns, the chassis 43 is free to again settle on the shelves 30 and 34. From the foregoing, it will be appreciated that the freely fitted chassis 43, necessary for ease and convenience in servicing the compactor, effects, in operation, the desired distribution of reaction forces.

I claim:

1. A trash compactor comprising a housing including interconnected top, side and end walls, a base, and a door at the front of the compactor, the lower part of said housing being a compacting chamber, a chassis, means detachably supporting said chassis on said end walls in the upper end of the housing for limited upward movement relative to said end and side walls, and trash compacting means including a compacting head and means connected to said chassis and operable to reciprocate said head between an upper inoperative position and operative positions in which trash in said chamber is subjected to compacting pressures, said chassis moving upwardly in response to reaction forces developing on application of said compacting pressures to trash and at its upper limit of travel transferring said forces to said side walls transversely of a substantial part of each of them and substantially at their junction with said top wall.

2. The trash compactor of claim 1 in which the means detachably supporting the chassis are front and rear shelves attached to and extending transversely respectively of end walls on which the ends of the chassis rests.

3. The trash compactor of claim 2 in which the trash compacting means include parts on the upper surface of the chassis and the chassis includes vertical walls at least along the sides thereof and dimensioned to extend above said parts and disposed to engage with the top wall of the housing substantially at its junctions with the housing side walls.

4. The trash compactor of claim 2 in which the side and top walls are integral parts of a metal sheet, the bottom edges of the side walls are anchored by the base of the housing and the ends of the top and side walls are folded at right angles towards each other and the shelves are secured to the inner surfaces of said folded ends.

5. The trash compactor of claim 3 in which the trash compacting means includes a pair of transversely aligned, centrally located depending members rotatably supported by the chassis with ends extending upwardly therethrough, a sprocket fixed on each of said ends, a motor below said chassis and supported thereby adjacent its rear end with its drive shaft extending upwardly through the chassis, a drive member fixed on said shaft above said chassis, a shaft mounted on the upper surface of said chassis adjacent the front end thereof and including a driven member and a sprocket, a chain interconnecting said sprockets and an endless member trained about said drive and driven members.

6. The trash compactor of claim 3 and a connection between the chassis and one of said shelves enabling the chassis to remain connected thereto when the other end of the chassis is not supported by the other shelf and is lowered to expose the upper surface of the chassis.

7. The trash compactor of claim 6 in which said one shelf is the front shelf and the other shelf is the rear shelf.

8. The trash compactor of claim 7 in which portions of the walls extending along the sides of the chassis are forwardly and downwardly inclined thus to enable the remainder of said chassis walls to be close to the housing top wall and still permit the rear end of the chassis to be lowered with its front end still on the front shelf.

9. The trash compactor of claim 8 in which the front shelf includes a marginal portion downwardly inclined towards the rear of the housing, and the connection between the chassis and said portion enables the chassis to be slid along said portion to a limited extent as the rear end of the chassis is lowered to expose the upper surface thereof.

10. The trash compactor of claim 9 in which the connection is separable when the chassis is lowered.

11. The trash compactor of claim 9 in which the connection includes pins depending from the front end of the chassis and said front shelf portion has pin receiving slots.

* * * * *